US005659344A

United States Patent [19]

Kagayama

[11] Patent Number: 5,659,344

[45] Date of Patent: Aug. 19, 1997

[54] IMAGE FORMING APPARATUS HAVING A PLURALITY OF APERATURE ELECTRODES AND INTERMINTENT OPENINGS FORMING AN ELECTROSTATIC FIELD

[75] Inventor: Shigeru Kagayama, Owariasahi, Japan

[73] Assignee: Brother Kogyo Kabushiki Kaisha, Nagoya, Japan

[21] Appl. No.: 418,209

[22] Filed: Apr. 7, 1995

[30] Foreign Application Priority Data

May 16, 1994 [JP] Japan ..... 6-100838

[51] Int. Cl.[6] ..... B41J 2/06

[52] U.S. Cl. ..... 347/55

[58] Field of Search ..... 347/55, 112, 158, 347/111, 141, 151, 120, 123; 355/261, 262

[56] References Cited

U.S. PATENT DOCUMENTS

| | | | |
|---|---|---|---|
| 3,689,935 | 9/1972 | Pressman et al. . | |
| 4,743,926 | 5/1988 | Schmidlin et al. . | |
| 4,755,837 | 7/1988 | Schmidlin et al. . | |
| 4,780,733 | 10/1988 | Schmidlin . | |
| 4,814,796 | 3/1989 | Schmidlin . | |
| 4,912,489 | 3/1990 | Schmidlin . | |
| 5,036,341 | 7/1991 | Larsson . | |
| 5,153,611 | 10/1992 | Kokado et al. | 347/55 |
| 5,404,159 | 4/1995 | Ohashi | 347/55 |
| 5,481,286 | 1/1996 | Kagayama | 347/55 |
| 5,504,509 | 4/1996 | Kagayama | 347/55 |
| 5,515,084 | 5/1996 | Larson | 347/55 |

*Primary Examiner*—Benjamin R. Fuller
*Assistant Examiner*—Charlene Dickens
*Attorney, Agent, or Firm*—Oliff & Berridge

[57] ABSTRACT

In an image forming apparatus, plural apertures are formed in a base member of an aperture electrode unit with a control electrode surrounding each aperture. Middle holes are formed between neighboring control electrodes. Each middle hole is controlled by the two neighboring control electrodes. An ON electric field is formed in the middle hole when both of the neighboring control electrodes adjacent to the middle hole are switched on. At this time, toner which is fed to a space between the apertures is passed through the middle hole. Therefore, continuous dots can be recorded in a direction perpendicular to a sheet feed direction. In addition, when the control electrodes at both sides of the middle hole are supplied with an OFF voltage at the same time, an image forming operation can be controlled without fog. Therefore, an image can be stably formed with excellent image quality.

20 Claims, 5 Drawing Sheets

IMAGE FORMING APPARATUS HAVING A PLURALITY OF APERATURE ELECTRODES AND INTERMINTENT OPENINGS FORMING AN ELECTROSTATIC FIELD

BACKGROUND OF THE INVENTION

1. Field of the Invention

The invention relates to an image forming apparatus which is usable for a copying machine, a printer, a plotter, a facsimile, or similar printing apparatus.

2. Description of Related Art

A conventionally known image forming apparatus is disclosed in U.S. Pat. No. 3,689,935. The apparatus uses an electrode having plural opening portions (hereinafter referred to as "apertures") and a voltage is applied to the electrode in accordance with image data to control passage of toner particles through the apertures, whereby an image is formed on a supporter (image receiving medium) with the passed toner particles.

The image forming apparatus includes an aperture electrode unit comprising an insulating flat plate, a reference electrode formed continuously on one surface of the flat plate, plural control electrodes which are formed on the other surface of the flat plate and electrically insulated from one another and at least one row of apertures, each aperture formed in correspondence with a control electrode so as to penetrate through the flat plate, the reference electrode and the corresponding control electrode; means for selectively applying a voltage across the reference electrode and the control electrodes; means for supplying charged toner particles so that the flow of the toner particles passed through the apertures is modulated in accordance with the applied voltage, and means for moving a supporter and the aperture electrode unit relative to one another to position the supporter in a particle flow passage.

Further, U.S. Pat. Nos. 4,743,926, 4,755,837, 4,780,733, and 4,814,796 disclose image forming apparatuses having an aperture electrode unit disposed so that control electrodes face a supporter and a reference electrode faces a toner supply side.

On the other hand, U.S. Pat. No. 4,912,489 discloses an aperture electrode unit disposed so that the reference electrode faces the supporter and the control electrodes face the toner supply side. The specification of U.S. Pat. No. 4,912,489 discloses that a voltage applied to the control electrodes at an off-time can be reduced to about a quarter of that of the image forming apparatus as disclosed in the above U.S. Patents.

The term "off-time" means a time when no toner particle is attached onto the supporter, that is, when a blank portion of an image is formed on the supporter. Conversely, the term "on-time" means a time when a toner image is formed on the supporter.

However, the conventional image forming apparatus as described above has the following problem during image recording. In order to form continuous dots in a direction perpendicular to the sheet feeding direction, in some cases the neighboring apertures are arranged in an alternating pattern such that one row of apertures covers the gaps of an adjacent row so the rows are overlapped with one another in the sheet feeding direction. However, an image formed by the aperture electrode unit as structured above has a problem that the print characteristic of the dots which are formed by the respective neighboring apertures arranged in the alternating pattern is varied in accordance with each aperture.

That is, a dot to be formed by an aperture is normally formed, however, a dot to be formed by an aperture adjacent to the former aperture is formed densely in print density, thereby inducing fog in the formed image. Accordingly, there occurs a problem that the dots formed by the neighboring apertures are different from each other in print density, so that it is very difficult to perform a stable recording operation for all arrays of apertures.

As a countermeasure for the above problem, it has been considered that the apertures be not arranged in a zigzag form, but that the apertures be aligned with one another in a direction perpendicular to the sheet feeding direction. However, in order to enable the continuous dots to be recorded in the direction perpendicular to the sheet feeding direction, the respective apertures are required to be continuous with each other. This requirement means that one large aperture must be formed in the longitudinal direction, and this is practically impossible.

SUMMARY OF THE INVENTION

An object of the invention is to provide an image forming apparatus which is capable of performing a stable image recording operation with excellent image quality.

In order to attain the above object, an image forming apparatus according to the invention comprises toner carrying means for carrying and supplying charged toner particles; electric-field control means for controlling a flow of the charged particles supplied from the toner carrying means; a back electrode disposed at an opposite side of the electric-field control means from the toner carrying means, wherein the electric-field control means includes a plurality of openings formed continuously in a row parallel to a longitudinal direction of the electric-field control means, each of the plurality of openings being formed between a pair of adjacent electrodes.

In the image forming apparatus thus structured, the plurality of openings are arranged on a row in a direction perpendicular to a sheet feed direction. With this arrangement, a contact state between the electric-field control means and the toner carrying means can be stabilized, a toner supply of the toner carrying means can be uniformly performed and an area of toner flow controlling portions can be enlarged so that a continuous line can be readily and surely recorded in the direction perpendicular to the sheet feed direction.

As is apparent from the foregoing, in the image forming apparatus of the invention, a plurality of openings are arranged on a row in the direction perpendicular to the sheet feed direction, the contact state between the electric-field control means and the toner carrying means can be stabilized, and the toner supply can be uniformly performed. Further, as the width of the dots to be formed is larger than the size of one opening, a continuous line can be readily and surely printed in the direction perpendicular to the sheet feed direction.

BRIEF DESCRIPTION OF THE DRAWINGS

Preferred embodiments of the invention will be described in detail with reference to the following figures wherein.

DETAILED DESCRIPTION OF THE PREFERRED EMBODIMENTS

A preferred embodiment according to the invention will be described hereunder with reference to the accompanying drawings.

Figure 1:
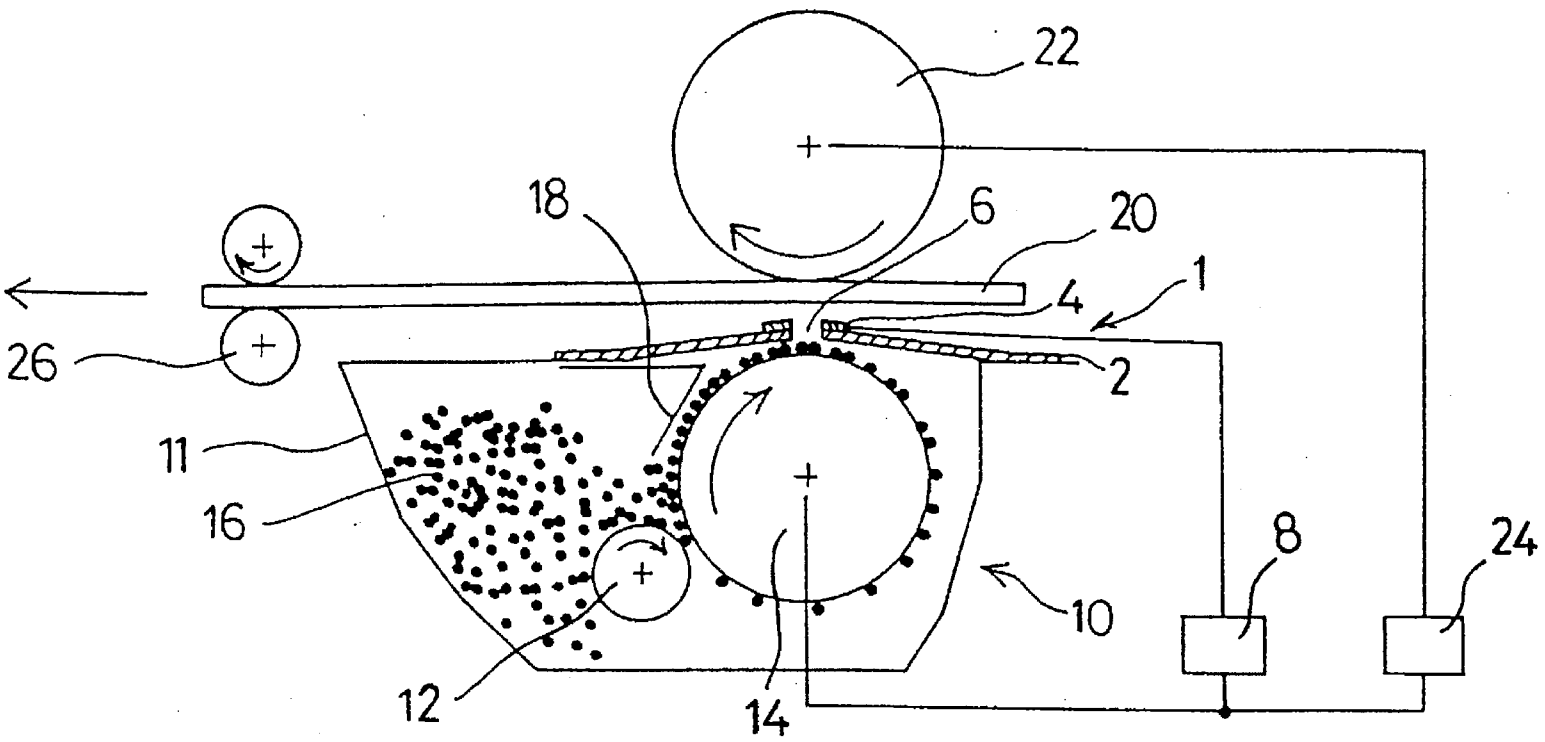
FIG. 1 is a diagram showing the construction of an image forming apparatus of an embodiment of the invention.

FIG. 1 schematically shows an image forming apparatus of an embodiment of the invention.

A cylindrical counter (back) electrode roller 22 serving as a counter (back) electrode is rotatably supported at the upper side of an aperture electrode unit 1 serving as electric-field control means by a chassis (not shown) so as to be spaced away from the aperture electrode unit 1 at an interval of 1 mm, whereby a supporter 20 (image receptor), which is inserted into the gap between the aperture electrode unit 1 and the counter electrode roller 22, can be fed through the gap in the left direction as shown by the arrow in FIG. 1. The aperture electrode unit 1 and the counter electrode roller 22 are disposed so that the longitudinal direction thereof is perpendicular to the feed direction of the supporter 20. Furthermore, a toner supply device 10 is disposed along the longitudinal direction of the aperture electrode unit 1 at the lower side of the aperture electrode unit 1. Still further, a fixing device 26 is disposed at the downstream side of the feed direction of the supporter 20, which is fed by the counter electrode roller 22.

The toner supply device 10 includes a toner case 11 which also serves as a housing for the apparatus, toner 16 serving as charged particles is stocked in the toner case 11. A toner supply roller 12; a toner carry roller 14, serving as a carry member; and a toner-layer restricting blade 18, serving as toner-layer restricting means are mounted in the toner case 11. The toner carry roller 14 carries the toner 16 thereon to feed the toner 16 to the aperture electrode unit 1. The toner supply roller 12 serves to supply the toner 16 to the toner carry roller 14.

The toner supply roller 12 and the toner carry roller 14 are supported by the toner case 11 so as to be rotatable in the directions indicated by the arrows in FIG. 1. The rollers 12,14 are disposed in parallel to and in contact with each other so that the rotational axis lines thereof are disposed in a direction perpendicular to the feed direction of the supporter 20. The toner-layer restricting blade 18 serves to adjust the amount of the toner on the toner carry roller 14 so that the amount of the toner is uniform over the roller surface and also serves to uniformly charge the toner 16. The toner-layer restricting blade 18 is pressed against the toner carry roller 14.

Figure 2:
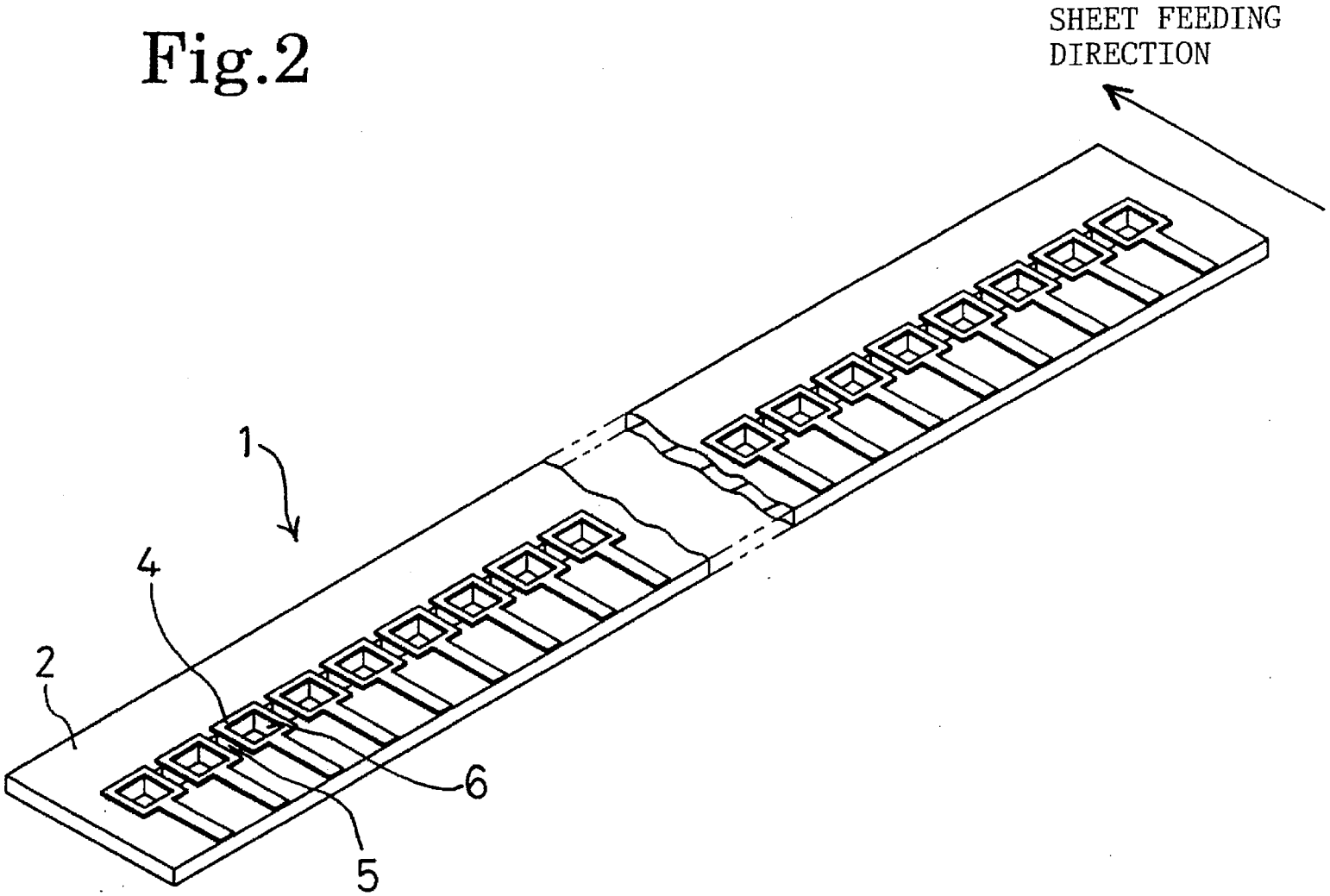
FIG. 2 is a perspective view showing the structure of an aperture electrode unit used in the image forming apparatus of the embodiment.

The aperture electrode unit 1 will be described in detail with reference to FIG. 2. The aperture electrode unit 1 comprises an insulation base member 2 of polyimide and 25 μm in thickness, an array of plural apertures 6 each of which is formed in a square shape having one side length of about 60 μm in the insulation base member 2, and control electrodes 4 each of which has a thickness of 8 μm around a corresponding aperture 6 on the insulation member 2. Each aperture 6 and corresponding control electrode 4 surrounding the aperture 6 constitute a control portion of the invention.

The base member 2 of the aperture electrode unit 1 has the same length as the width (recording width) of the supporter 20, and the arrangement pitch of the apertures 6 on the insulation member 2 is set to 125 μm for 200 dpi, for example. Assuming that the width of each control electrode 4 is equal to 20 μm in a direction perpendicular to the sheet feed direction, there exists a space having 25 μm width between the neighboring control electrodes 4. In this embodiment, a middle hole 5 which has substantially the same size as the aperture 6 in the sheet feed direction is provided in each space. Accordingly, the respective apertures 6 and the middle holes 5 are aligned with one another in the longitudinal direction of the base member 2 and the middle holes 5 constitute the opening portions of the invention. Both ends of each middle hole 5 are in contact with the control electrodes 4 adjacent to the sides of the middle hole 5. The electric field produced in the hole 5 is determined by a voltage which is applied to the neighboring control electrodes 4 located on the both sides adjacent the middle hole 5.

The aperture electrode unit 1 is pressed against the toner carry roller 14 at its aperture position in a state where the control electrodes 4 confront to the supporter 20 as shown in FIG. 1.

Figure 3:
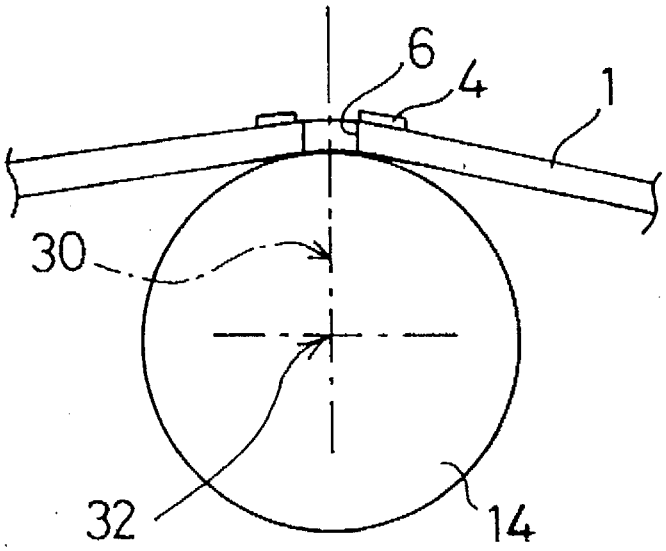
FIG. 3 is a schematic view showing the aperture electrode unit and a toner carry roller used in the image forming apparatus of the embodiment.

The positional relationship between the apertures 6 of the aperture electrode unit 1 and the toner carry roller 14 will be described in detail. As shown in FIG. 3, each aperture 6 and each middle hole 5 are arranged so that the central axis 30 thereof passes through the uppermost portion of the peripheral surface and the central axis of the toner carry roller 14. As described above, the respective apertures 6 and the respective middle holes 5 are arranged so as to be symmetrical at the right and left sides thereof with respect to the uppermost portion of the peripheral surface of the toner carry roller 14, whereby the distribution of the toner 16 passing through the apertures 6 and the middle holes 5 can be made uniform over the entire area of the apertures. Further, since the side surfaces of the walls of the apertures and the middle holes 5 are parallel to the flight direction of the toner 16, the toner can straightly fly toward the supporter.

As shown in FIG. 3, the aperture electrode unit 1 itself is pressed against the toner carry roller 14 so that it is bent to the right and left sides thereof at the same angle with respect to the apertures 6 and the middle holes 5. With this structure, the contact area between the aperture electrode unit 1 and the toner carry roller 14 can be increased. Further, the lower peripheral portions of the apertures 6 and the middle holes 5 can be pressed uniformly at the right and left sides thereof so that unevenness of the toner density can be suppressed at maximum.

A control voltage applying circuit 8, serving as control voltage applying means, is connected between the control electrodes 4 and the toner carry roller 14. It applies a voltage of 0 V or +50 v to the control electrodes 4 in accordance with an image signal.

A DC power source 24 is also connected between the counter electrode 22 and the toner carry roller 14. It applies a voltage of +1 kV to the counter electrode roller 22.

Next, the operation of the image forming apparatus thus structured will be described.

First, the toner carry roller 14 and the toner supply roller 12 are rotated in the directions as indicated by the arrows of FIG. 1. Through the rotation of the rollers 14, 12, the toner 16, which is fed from the toner carry roller 12, is rubbed against the toner carry roller 14 to be negatively charged and is then carried on the toner carry roller 14. The toner 16 carried on the toner carry roller 14 is thinned and further charged by the toner-layer restricting blade 18 and then fed toward the aperture electrode unit by the rotation of the toner carry roller 14. Thereafter, the toner on the toner carry roller 14 is supplied to the lower sides of the apertures 6 and the middle holes 5 while rubbed against the insulation base member 2 of the aperture electrode unit 1.

At this time, the control electrodes 4 corresponding to an image portion are supplied with a voltage of +50 V from the control voltage applying circuit 8 in accordance with the image signal. As a result, electric lines of force directed from the control electrodes 4 to the toner carry roller 14 are produced in the neighborhood of the apertures 6 corresponding to the image portion due to the potential difference between the control electrodes 4 and toner carry roller 14. With the electric lines of force, the negatively charged toner 16 is electrostatically attracted to the higher potential side. Thus, the toner 16 is drawn from the surface of the toner carry roller 14 through the apertures 6 toward the control electrodes 4. The drawn-out toner 16 further flies toward the supporter 20 as a result of the electric field which is produced between the supporter 20 and the aperture electrode unit 1 by a voltage applied to the counter electrode 22 so that the toner 16 is deposited on the supporter 20 and picture elements are formed thereon.

On the other hand, the control electrodes 4 corresponding to a non-image portion are supplied with a voltage of 0 V from the control voltage applying circuit 8 and, thus, no electric field is produced between the toner carry roller 14 and the control electrodes 4 that do not receive a voltage. Therefore, the toner 16 on the toner carry roller 14 suffers no electrostatic attraction force and is not passed through the apertures 6.

According to the aperture electrode unit 1 thus structured, continuous dots can be recorded in the direction perpendicular to the sheet feed direction.

Figure 4A:
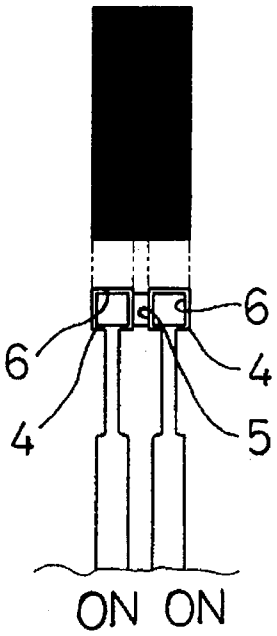
FIG. 4A is a plan view showing a print state by the aperture electrode unit of the embodiment.
Figure 4B:
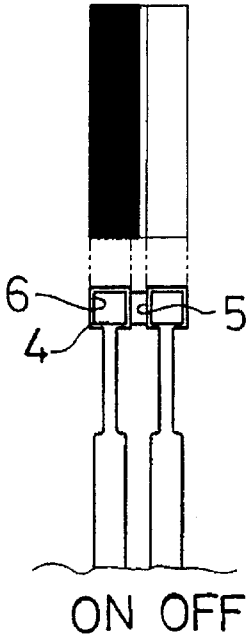
FIG. 4B is a plan view showing the print state by the aperture electrode unit of the embodiment.
Figure 4C:
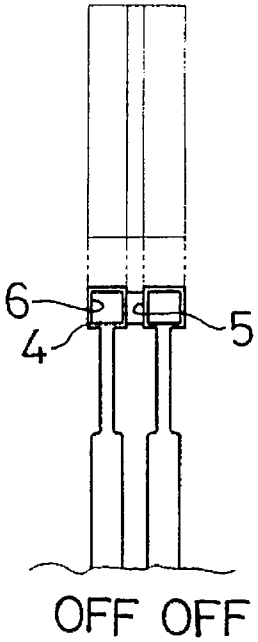
FIG. 4C is a plan view showing the print state by the aperture electrode unit of the embodiment.
Figure 4D:
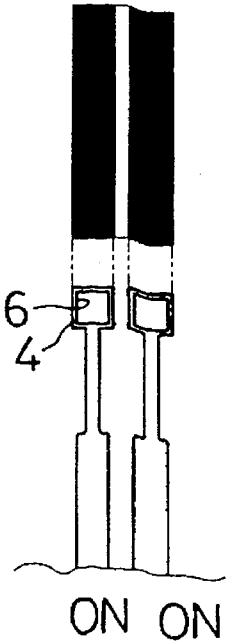
Fig.4D RELATED ART
FIG. 4D is a plan view showing the print state by the conventional aperture electrode unit.

FIGS. 4A to 4D are plan views showing schematically a print state of two neighboring control electrodes 4. FIG. 4A shows a print state when the two neighboring control electrodes 4 are supplied with a voltage of +50 V from the control voltage applying circuit 8 at the same time and switched on at the same time. FIG. 4B shows a print state when one of the neighboring control electrodes 4 is supplied with a voltage of +50 V and switched on while the other is supplied with a voltage of 0 V and switched off. FIG. 4C shows a print state when the neighboring control electrodes 4 are supplied with a voltage of 0 V and switched off. FIG. 4D shows a print state in the prior art when the neighboring control electrodes 4 are switched on.

In the conventional aperture electrode unit, no middle hole is provided between the neighboring apertures 6. Therefore, even when both of the neighboring control electrodes 4 are supplied with a voltage of +50 V and switched on, the toner which is fed to the space between the neighboring apertures cannot fly toward the supporter 20. Accordingly, as shown in FIG. 4D, even when the neighboring control electrodes 4 are switched on, there is formed a gap between toner images (picture elements) which are passed through the neighboring apertures 6 respectively and formed on the supporter 20. Therefore, a continuous image cannot be formed in the direction perpendicular to the sheet feed direction and solid print and line drawing cannot be performed using the prior art devices.

In this embodiment, the middle hole 5 is provided between the neighboring apertures 6. When the control electrodes at both sides of a middle hole 5 are supplied with a voltage of +50 V and switched on, the control electric field is formed in the middle hole between the switched-on control electrodes 4. Therefore, the toner which is fed to the space between the apertures 6 and, thus, cannot pass through the apertures 6 to the supporter, can pass through the middle hole 5 by an ON electric field which is produced in the middle hole 5 when the control electrodes 4 are switched on. Accordingly, as shown in FIG. 4A, the continuous dots can be recorded in the direction perpendicular to the sheet feed direction and the solid print and the line drawing can be performed. In addition, as shown in FIG. 4C, when the neighboring control electrodes 4 at both sides of a middle hole 5 are simultaneously supplied with an off-voltage (0 V), the print operation can be controlled without any fog.

Furthermore, as shown in FIG. 4B, when the neighboring control electrodes 4 are switched on and off respectively, the electric field in the middle hole 5 varies stepwise from the OFF electric field to the ON electric field. That is, the ON electric field is formed at a side of the middle hole 5 which is near to the control electrode 4 in the ON state, and the OFF electric field is formed at a side of the middle hole 5 which is near to the control electrode 4 in the OFF state. The toner 16 is on/off-controlled by the electric fields formed in the middle hole 5 as described above. That is, the ON electric field is formed in a half area of the middle hole 5 which extends from the one end side of the middle hole 5 to the substantial center of the middle hole 5 in the width direction and the OFF electric field is formed in the other half area which extends from the other end side of the middle hole 5 to the substantial center of the middle hole 5, so that the toner 16 is emitted from one half area of the middle hole 5 and no toner 16 is emitted from the other area of the middle hole 5.

As described above, the continuous dots cannot be formed in the direction perpendicular to the sheet feed direction in the prior art. However, in this embodiment, a continuous line can be printed in the width direction at the ON-time and no fog occurs at the OFF-time. In addition, even when the neighboring control electrodes 4 are supplied with different voltages, the dots can be formed in accordance with the ON and OFF states of the respective control electrodes 4. That is, with the structure as described above, even when the aperture is formed not to be long, or extended, in the longitudinal direction of the aperture electrode unit 1, a continuous "dot" can be formed in the direction perpendicular to the sheet feed direction using the aperture electrode unit 1 having apertures each of which has a small width in the longitudinal direction of the aperture electrode unit 1, and thus the apertures 6 can be aligned with one another. Accordingly, the one-row arrangement of the apertures 6 can be realized, so that the contact state between the control electrodes 4 and the toner carry roller 14 is stabilized. Therefore, an image can be output that has excellent image quality.

The supporter 20 is fed in the direction perpendicular to the aperture array by a distance corresponding to one picture element while one picture-element array is formed on the surface of the supporter 20 with the toner 16, and a toner image is formed on the whole surface of the supporter 20 by repeating the above process. Thereafter, the formed toner image is fixed onto the supporter 20 by the fixing device 26.

In the image forming apparatus thus structured, if insulation toner is used as the toner 16, insulation is kept between the toner carry roller 14 and the control electrodes 4, so that the apertures 6 are not broken down.

In the above process, since the control electric field is formed using the control electrodes 4, the apertures 6 and the middle holes 5, and the toner carry surface of the toner carry roller 14, the control electric field is directly applied to the carried toner 16 so that control efficiency is high.

Furthermore, even when a part of the toner 16, which is fed to the lower sides of the apertures 6 by the toner carry roller 14, invades the apertures 6 or middle holes 5 for the non-image portion as a result of the mechanical force which is caused through sliding between the toner carry roller 14 and the aperture electrode unit 1, the toner can be controlled not to pass through the apertures 6 and the middle holes 5 with the electric field produced in the apertures 6 and the middle holes 5 so that control performance of the toner is excellent.

In addition, since the toner carry roller 14 and the aperture electrode unit 1 are disposed so as to confront each other through the toner layer, these elements can be disposed at a relatively short distance, so that the control voltage can be set to a low value and a low-price driving element can be used.

Furthermore, the insulation sheet (base member) 2 of the aperture electrode unit 1 is disposed so as to confront the toner carry roller 14. Therefore, even if no toner exists on the toner carry roller 14 due to a failure of the toner supply system, the control electrodes 4 and the toner carry roller 14 can be prevented from being contacted with each other and thus electrically short-circuited so that the driving element is not damaged.

Still further, the aperture electrode unit 1 and the toner 16 on the toner carry roller 14 are in contact with each other at the inlet portions of the apertures 6 and the middle holes 5 (at the upstream sides of the apertures 6 and the middle holes 5 in the toner feed direction), the toner deposited at the inlet portions of the apertures 6 and the middle holes 5 is pushed out by the toner which is successively supplied from the toner carry roller 14. Therefore, there occurs no case where the toner 16 is deposited in the vicinity of the apertures 6 and the middle holes 5 and bridged to clog the apertures 6 and the middle holes 5.

The invention is not limited to the above embodiment. Various modifications may be made without departing from the subject matter of the invention.

For example, in the above embodiment, the control voltage for the apertures corresponding to the non-image portion is set to 0 V, however, it may be a negative voltage. In this case, an image having less fog can be obtained. Furthermore, in the above embodiment an aperture electrode unit is used as the toner flow control means, however, a mesh-shaped electrode unit as disclosed in U.S. Pat. No. 5,036,341 may be used.

Figure 5:
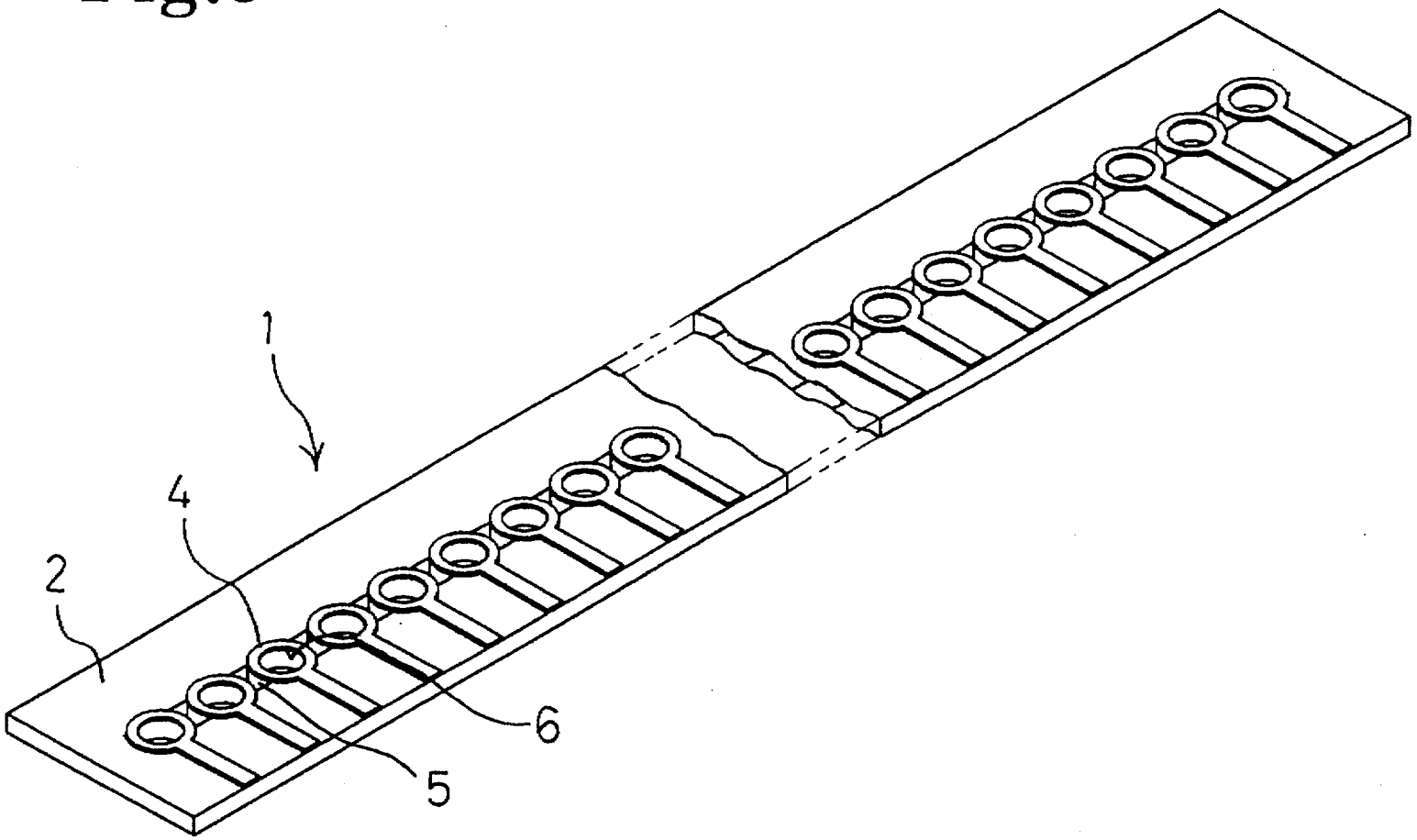
FIG. 5 is a perspective view showing another embodiment of the aperture electrode unit.

Furthermore, in the above embodiment, the aperture electrode unit has square apertures. However, the invention is applicable to an aperture having round apertures, as shown in FIG. 5, or an elliptical shape.

What is claimed is:

1. An image forming apparatus, comprising:

toner carrying means for carrying and supplying charged toner particles;

a back electrode; and electric-field control means disposed between the toner carrying means and the back electrode for controlling a flow of the charged particles supplied from said toner carrying means, said electric-field control means includes:

a plurality of openings formed in a row parallel to a longitudinal direction of said electric-field control means; and a plurality of electrodes disposed on said electric-field control means such that an electrode surrounds every other opening;

wherein continuous dots are recorded in the longitudinal direction of the electric-field control means.

2. The image forming apparatus as claimed in claim 1, wherein said electric-field control means comprises a base member, the plurality of openings formed through the base member and the charged toner particles being passed through the plurality of openings formed through the base member toward said back electrode.

3. The image forming apparatus as claimed in claim 2, wherein said electric-field control means is disposed so as to come into contact with said toner carrying means through the charged toner particles carried on said toner carrying means.

4. The image forming apparatus as claimed in claim 3, wherein an alternative one of the plurality of openings has an electrode therearound.

5. The image forming apparatus as claimed in claim 3, wherein flow of toner through adjacent openings is controlled by an electrode between the adjacent openings.

6. An image forming apparatus, comprising:

toner supply means for supplying charged toner particles;

print medium supply means for passing a print medium by a print position;

a counter electrode on one side of the print position; and an electric-field control unit on an opposite side of the print position to oppose said counter electrode, said electric-field control unit comprising:

an insulation base member;

a plurality of control electrodes including at least one pair of adjacent control electrodes;

an opening passing through each control electrode and said insulation base member; and a hole passing through said insulation base member between the at least one pair of adjacent control electrodes;

wherein continuous dots recorded.

7. The image forming apparatus as claimed in claim 6, wherein said openings have a square shape.

8. The image forming apparatus as claimed in claim 6, wherein said openings have a circular shape.

9. The image forming apparatus as claimed in claim 6, wherein said openings have an elliptical shape.

10. The image forming apparatus as claimed in claim 9, wherein the print medium passes over the elliptical shaped openings in a feeding direction, the elliptical shaped openings have a direction of elongation, and the direction of elongation of said elliptical shaped openings is transverse to the feeding direction of said print medium.

11. The image forming apparatus as claimed in claim 6, wherein each said hole has both side edges defined by said control electrodes of the at least one pair of adjacent control electrodes.

12. The image forming apparatus as claimed in claim 6, wherein the insulation base member has a longitudinal axis, and said openings and said holes are centered on a line parallel to the longitudinal axis of said insulation base member.

13. The image forming apparatus as claimed in claim 6, further including means for providing an electrical charge to said counter electrode and to each of said control electrodes.

14. The image forming apparatus as claimed in claim 13, wherein said toner supply means supplies toner to said electric-field control unit.

15. An image forming apparatus, comprising:

toner supply means for supplying charged toner particles;

an aperture electrode unit adjacent said toner supply means;

a counter electrode opposite said aperture electrode unit and on a side of said aperture electrode unit away from said toner supply means; and recording medium feed means for feeding a recording medium past a print position between said aperture electrode unit and said counter electrode, wherein said aperture electrode unit comprises:

an insulation base member;

a plurality of apertures; and a plurality of control electrodes, a control electrode surrounding every other aperture;

wherein continuous dots recorded.

16. The image forming apparatus as claimed in claim 15, wherein there is an odd number of apertures and a first control electrode surrounds a first aperture.

17. The image forming apparatus claimed in claim 16, wherein said apertures surrounded by said control electrodes have a round shape.

18. The image forming apparatus as claimed in claim 16, wherein said apertures surrounded by said control electrodes have a square shape.

19. The image forming apparatus as claimed in claim 16, wherein said apertures surrounded by said control electrodes have an elliptical shape.

20. The image forming apparatus as claimed in claim 15, wherein the insulation base member has a longitudinal axis, and said apertures are centered on a line parallel to the longitudinal axis of said insulation base member.

* * * * *

UNITED STATES PATENT AND TRADEMARK OFFICE

CERTIFICATE OF CORRECTION

PATENT NO. : 5,659,344

DATED : August 19, 1997

INVENTOR(S) : Shigeru KAGAYAMA

It is certified that error appears in the above-indentified patent and that said Letters Patent is hereby corrected as shown below:

On the Title page, in item [54], change "APERATURE" to --APERTURE--; and change "Intermintent" to -- INTERMITTENT--.

Column 1, change "APERATURE" to --APERTURE--; and change "Intermintent-- to --INTERMITTENT--.

Signed and Sealed this

Tenth Day of February, 1998

Bruce Lehman

*Attest:*

BRUCE LEHMAN

*Attesting Officer*

*Commissioner of Patents and Trademarks*